US010584540B2

(12) United States Patent
Borge

(10) Patent No.: US 10,584,540 B2
(45) Date of Patent: Mar. 10, 2020

(54) CUTTING TABLES INCLUDING FLUID FLOW PATHWAYS, AND RELATED CUTTING ELEMENTS, AND EARTH-BORING TOOLS

(71) Applicant: Baker Hughes, a GE company, LLC, Houston, TX (US)

(72) Inventor: Richard Wayne Borge, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 11 days.

(21) Appl. No.: 15/966,881

(22) Filed: Apr. 30, 2018

(65) Prior Publication Data

US 2018/0313163 A1 Nov. 1, 2018

Related U.S. Application Data

(60) Provisional application No. 62/492,378, filed on May 1, 2017.

(51) Int. Cl.

| | |
|---|---|
| ***E21B 10/60*** | (2006.01) |
| ***E21B 10/61*** | (2006.01) |
| *E21B 10/54* | (2006.01) |
| *E21B 10/46* | (2006.01) |
| *E21B 3/04* | (2006.01) |
| *E21B 10/567* | (2006.01) |

(52) U.S. Cl.
CPC ..... *E21B 10/60* (2013.01); *E21B 10/61* (2013.01); *E21B 3/04* (2013.01); *E21B 10/46* (2013.01); *E21B 10/5673* (2013.01); *E21B 2010/545* (2013.01)

(58) Field of Classification Search
CPC ..... E21B 10/60; E21B 10/61
See application file for complete search history.

(56) References Cited

U.S. PATENT DOCUMENTS

| | | | | |
|---|---|---|---|---|
| 4,224,380 | A | | 9/1980 | Bovenkerk et al. |
| 5,127,923 | A | | 7/1992 | Bunting et al. |
| 5,316,095 | A | * | 5/1994 | Tibbitts ..... E21B 10/567 |
| 5,590,729 | A | | 1/1997 | Cooley et al. |
| 6,986,297 | B2 | | 1/2006 | Scott |
| 9,259,803 | B2 | | 2/2016 | DiGiovanni |

FOREIGN PATENT DOCUMENTS

| | | | |
|---|---|---|---|
| CN | 104763347 | A | 7/2015 |

* cited by examiner

*Primary Examiner* — Kristyn A Hall
(74) *Attorney, Agent, or Firm* — TraskBritt

(57) ABSTRACT

A cutting table comprises hard material, and a fluid flow pathway within the hard material. The fluid flow pathway is configured to direct fluid proximate outermost boundaries of the hard material through one or more regions of the hard material inward of the outermost boundary of the hard material. A cutting element and an earth-boring tool are also described.

18 Claims, 10 Drawing Sheets

CUTTING TABLES INCLUDING FLUID FLOW PATHWAYS, AND RELATED CUTTING ELEMENTS, AND EARTH-BORING TOOLS

CROSS-REFERENCE TO RELATED APPLICATION

This application claims the benefit under 35 U.S.C. § 119(e) of U.S. Provisional Patent Application Ser. No. 62/492,378, filed May 1, 2017, the disclosure of which is hereby incorporated herein in its entirety by this reference.

TECHNICAL FIELD

Embodiments of the disclosure relate to cutting tables including fluid flow pathways, and to related cutting elements, earth-boring tools, and methods of forming the cutting tables, cutting elements, and earth-boring tools.

BACKGROUND

Earth-boring tools for forming wellbores in subterranean formations may include cutting elements secured to a body. For example, a fixed-cutter earth-boring rotary drill bit ("drag bit") may include cutting elements fixedly attached to a bit body thereof. As another example, a roller cone earth-boring rotary drill bit may include cutting elements secured to cones mounted on bearing pins extending from legs of a bit body. Other examples of earth-boring tools utilizing cutting elements include, but are not limited to, core bits, bi-center bits, eccentric bits, hybrid bits (e.g., rolling components in combination with fixed cutting elements), reamers, and casing milling tools.

Cutting elements used in earth-boring tools often include a supporting substrate and cutting table, wherein the cutting table comprises a volume of superabrasive material, such as a volume of polycrystalline diamond ("PCD") material, on or over the supporting substrate. Surfaces of the cutting table act as cutting surfaces of the cutting element. During a drilling operation, cutting edges at least partially defined by peripheral portions of the cutting surfaces of the cutting elements are pressed into the formation. As the earth-boring tool moves (e.g., rotates) relative to the subterranean formation, the cutting elements drag across surfaces of the subterranean formation and the cutting edges shear away formation material.

During a drilling operation, the cutting elements of an earth-boring tool may be subjected to high temperatures (e.g., due to friction between the cutting table and the subterranean formation being cut), which can result in undesirable thermal damage to the cutting tables of the cutting elements. Such thermal damage can cause one or more of decreased cutting efficiency, premature wear of the cutting tables, spalling of the cutting tables, separation of the cutting tables from the supporting substrates of the cutting elements, and separation of the cutting elements from the earth-boring tool to which they are secured.

Accordingly, it would be desirable to have cutting tables, cutting elements, earth-boring tools (e.g., rotary drill bits), and methods of forming and using the cutting tables, the cutting elements, and the earth-boring tools facilitating enhanced cutting efficiency and prolonged operational life during drilling operations as compared to conventional cutting tables, conventional cutting elements, conventional earth-boring tools, and conventional methods of forming and using the conventional cutting tables, the conventional cutting elements, and the conventional earth-boring tools.

BRIEF SUMMARY

Embodiments described herein include cutting tables including the cutting tables, cutting elements, and earth-boring tools including the cutting elements. For example, in accordance with one embodiment described herein, a cutting table comprises a hard material and a fluid flow pathway within the hard material. The fluid flow pathway is configured to direct fluid proximate outermost boundaries of the hard material through one or more regions of the hard material inward of the outermost boundary of the hard material.

In additional embodiments, a cutting element comprises a supporting substrate and a cutting table over the supporting substrate. The cutting table exhibits a side surface and a cutting surface. The cutting table comprises a hard material and a fluid flow pathway within the hard material. The fluid flow pathway is configured to direct drilling fluid proximate one or more of the side surface and the cutting surface of the cutting table through one or more regions of the hard material inward of the outermost boundary of the hard material.

In further embodiments, an earth-boring tool comprises a structure having at least one pocket therein, and at least one cutting element secured within the at least one pocket in the structure. The at least one cutting element comprises a supporting substrate and a cutting table over the supporting substrate. The cutting table exhibits a side surface and a cutting surface. The cutting table comprises a hard material and a fluid flow pathway within the hard material. The fluid flow pathway is configured to direct drilling fluid from an inlet port at an outermost boundary of the hard material, through one or more regions of the hard material inward of the outermost boundary of the hard material, and to an outlet port at another outermost boundary of the hard material.

DETAILED DESCRIPTION

Figure 1B:
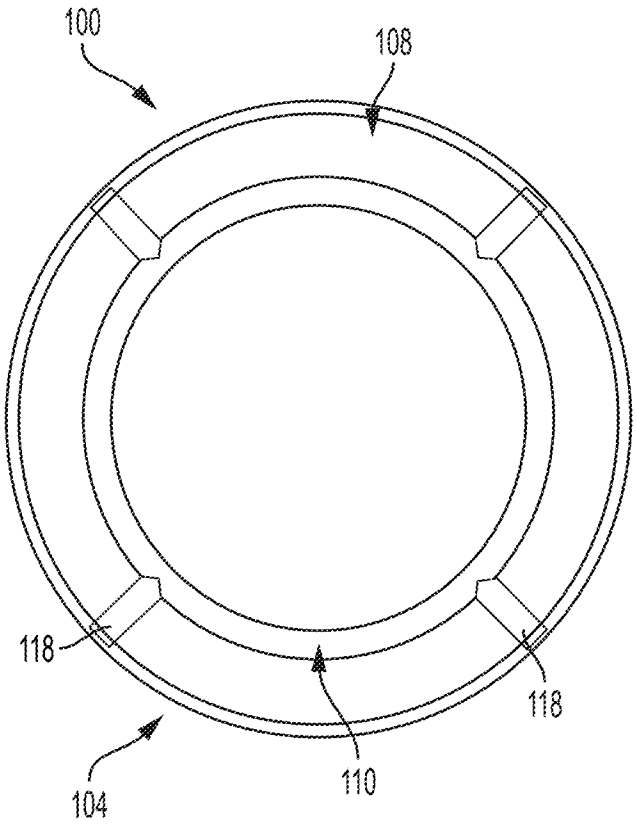
FIGS. 1A and 1B are perspective (FIG. 1A) and cross-sectional (FIG. 1B) views of a cutting element configuration, in accordance with embodiments of the disclosure.

Cutting tables and cutting elements for use in earth-boring tools are described, as are earth-boring tools including the cutting elements, and methods of forming and using the cutting tables, the cutting elements, and the earth-boring tools. In some embodiments, a cutting table includes a hard material, and one or more fluid flow pathways extending (e.g., longitudinally extending, laterally extending) through the hard material. The fluid flow pathways are configured and positioned to receive fluid (e.g., drilling fluid, such as drilling mud) proximate external surfaces (e.g., a side surface, a cutting surface) of the cutting table during use and operation of the cutting table to cool one or more internal portions of the hard material of the cutting table. The fluid flow pathways may include tunnels (e.g., through openings, through vias) embedded within and traversing through a hard material of the cutting table, and/or may include trenches (e.g., blind openings, blind vias) extending into the hard material from the outermost longitudinal boundaries of the hard material. One or more inlets (e.g., inlet ports) of the fluid flow pathways may be oriented toward one or more locations of elevated fluid velocity along an earth-boring tool to enhance flow of the fluid through the fluid flow pathways. The fluid flow pathways may be configured to selectively cool relatively higher temperature regions of the hard material with the fluid during the use and operation of the cutting table, and may also be configured to utilize temperature gradients within the cutting table to direct the fluid therethrough. The configurations of the cutting tables, cutting elements, and earth-boring tools described herein may provide enhanced drilling efficiency and improved operational life as compared to the configurations of conventional cutting tables, conventional cutting elements, and conventional earth-boring tools.

The following description provides specific details, such as specific shapes, specific sizes, specific material compositions, and specific processing conditions, in order to provide a thorough description of embodiments of the present disclosure. However, a person of ordinary skill in the art would understand that the embodiments of the disclosure may be practiced without necessarily employing these specific details. Embodiments of the disclosure may be practiced in conjunction with conventional fabrication techniques employed in the industry. In addition, the description provided below does not form a complete process flow for manufacturing a cutting element or earth-boring tool. Only those process acts and structures necessary to understand the embodiments of the disclosure are described in detail below. Additional acts to form a complete cutting element or a complete earth-boring tool from the structures described herein may be performed by conventional fabrication processes.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the terms "comprising," "including," "containing," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature, or method act indicates that such is contemplated for use in implementation of an embodiment of the disclosure and such term is used in preference to the more restrictive term "is" so as to avoid any implication that other, compatible materials, structures, features, and methods usable in combination therewith should or must be excluded.

As used herein, the terms "longitudinal," "vertical," "lateral," and "horizontal" and are in reference to a major plane of a substrate (e.g., base material, base structure, base construction, etc.) in or on which one or more structures and/or feature are formed and are not necessarily defined by earth's gravitational field. A "lateral" or "horizontal" direction is a direction that is substantially parallel to the major plane of the substrate, while a "longitudinal" or "vertical" direction is a direction that is substantially perpendicular to the major plane of the substrate. The major plane of the substrate is defined by a surface of the substrate having a relatively large area compared to other surfaces of the substrate.

As used herein, spatially relative terms, such as "beneath," "below," "lower," "bottom," "above," "over," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "over" or "above" or "on" or "on top of" other elements or features would then be oriented "below" or "beneath" or "under" or "on bottom of" the other elements or features. Thus, the term "over" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, the term "and/or" includes any and all combinations of one or more of the associated listed items As used herein, the term "configured" refers to a size, shape, material composition, material distribution, orientation, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, at least 99.9% met, or even 100.0% met.

As used herein, the term "about" in reference to a given parameter is inclusive of the stated value and has the meaning dictated by the context (e.g., it includes the degree of error associated with measurement of the given parameter).

As used herein, the terms "earth-boring tool" and "earth-boring drill bit" mean and include any type of bit or tool used for drilling during the formation or enlargement of a wellbore in a subterranean formation and include, for example, fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

As used herein, the term "polycrystalline compact" means and includes any structure comprising a polycrystalline material formed by a process that involves application of pressure (e.g., compaction) to the precursor material or materials used to form the polycrystalline material. In turn, as used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "inter-granular bond" means and includes any direct atomic bond (e.g., covalent, metallic, etc.) between atoms in adjacent grains of hard material.

As used herein, the term "hard material" means and includes any material having a Knoop hardness value of greater than or equal to about 3,000 $Kg_f/mm^2$ (29,420 MPa). Non-limiting examples of hard materials include diamond (e.g., natural diamond, synthetic diamond, or combinations thereof), or cubic boron nitride.

Figure 1A:
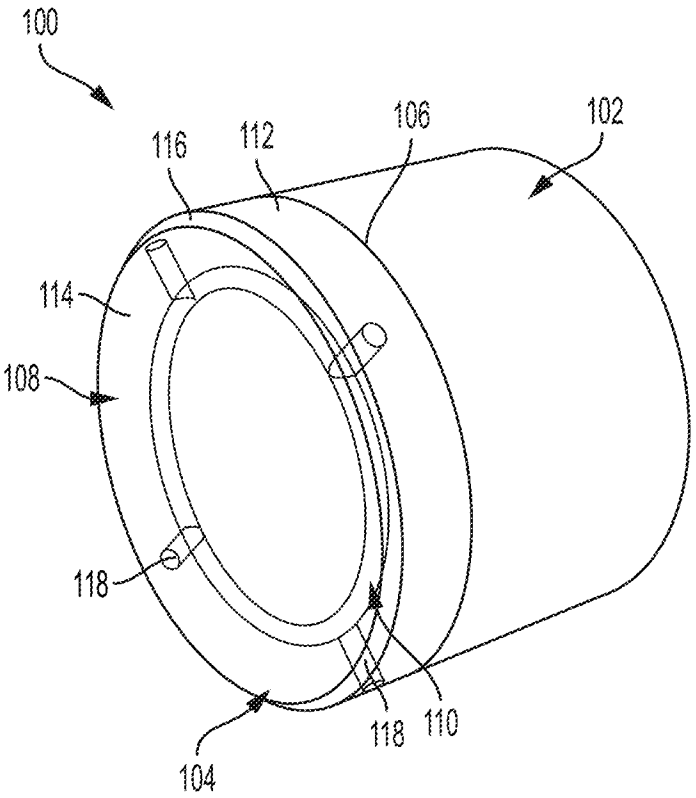

FIG. 1A illustrates perspective view of a cutting element 100, in accordance with an embodiment of the disclosure. The cutting element 100 includes a supporting substrate 102, and a cutting table 104 attached (e.g., bonded, adhered) to the supporting substrate 102 at an interface 106. FIG. 1B is a transverse cross-sectional view of the cutting element 100 shown in FIG. 1A taken through the cutting table 104 thereof. While FIGS. 1A and 1B depict a particular cutting element configuration, one of ordinary skill in the art will appreciate that different cutting element configurations are known in the art which may be adapted to be employed in embodiments of the disclosure. Namely, FIGS. 1A and 1B illustrate a non-limiting example of a cutting element configuration of the disclosure.

The supporting substrate 102 may be formed of and include a material that is relatively hard and resistant to wear. By way of non-limiting example, the supporting substrate 102 may be formed from and include a ceramic-metal composite material (also referred to as a "cermet" material). In some embodiments, the supporting substrate 102 is formed of and includes a cemented carbide material, such as a cemented tungsten carbide material, in which tungsten carbide particles are cemented together in a metallic binder material. As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide. The metallic binder material may include, for example, a catalyst material such as cobalt, nickel, iron, or alloys and mixtures thereof. In some embodiments, the supporting substrate 102 is formed of and includes a cobalt-cemented tungsten carbide material.

The supporting substrate 102 may exhibit any desired peripheral (e.g., outermost) geometric configuration (e.g., peripheral shape and peripheral size). The supporting substrate 102 may, for example, exhibit a peripheral shape and a peripheral size at least partially complementary to (e.g., substantially similar to) a peripheral geometric configuration of at least a portion of the cutting table 104 thereon or thereover. The peripheral shape and the peripheral size of the supporting substrate 102 may also be configured to permit the supporting substrate 102 to be received within and/or located upon an earth-boring tool, as described in further detail below. By way of non-limiting example, as shown in FIG. 1A, the supporting substrate 102 may exhibit a circular cylinder shape. In additional embodiments, the supporting substrate 102 may exhibit a different peripheral shape (e.g., a conical shape; a frustoconical shape; truncated versions thereof; or an irregular shape, such as a complex shape complementary to both of the cutting table 104 thereon or thereover and a recess or socket in an earth-boring tool to receive and hold the supporting substrate 102). In addition, the interface 106 between the supporting substrate 102 and the cutting table 104 (and, hence, opposing surfaces of the supporting substrate 102 and the cutting table 104) may be substantially planar, or may be non-planar (e.g., curved, angled, jagged, sinusoidal, V-shaped, U-shaped, irregularly shaped, combinations thereof, etc.).

The cutting table 104 may be positioned on or over the supporting substrate 102, and includes a hard material 108 and at least one fluid flow pathway 110 located (e.g., embedded) within the hard material 108. As shown in FIG. 1A, the cutting table 104 may include at least one side surface 112 (e.g., sidewall, barrel wall), at least one cutting surface 114 (e.g., top surface, uppermost surface) opposite the interface 106 between the supporting substrate 102 and the cutting table 104, and at least one cutting edge 116 between the side surface 112 and the cutting surface 114.

The cutting table 104 may exhibit any desired peripheral geometric configuration (e.g., peripheral shape and peripheral size). The peripheral geometric configuration of the cutting table 104 may, for example, be tailored to control (e.g., facilitate, promote) the flow of fluid (e.g., drilling fluid, such as drilling mud) into and through the fluid flow pathway 110 of the cutting table 104 from outermost boundaries (e.g., the side surface 112, the cutting surface 114) of the cutting table 104, as described in further detail below. In some embodiments, the cutting table 104 exhibits a circular cylinder shape including a substantially consistent (e.g., substantially uniform, substantially non-variable) circular lateral cross-sectional shape throughout a longitudinal thickness thereof. In additional embodiments, the cutting table 104 exhibits a different peripheral geometric configuration. For example, the cutting table 104 may comprise a three-dimensional (3D) structure exhibiting a substantially consistent lateral cross-sectional shape but variable (e.g., non-consistent, such as increasing and/or decreasing) lateral cross-sectional dimensions throughout the longitudinal thickness thereof, may comprise a 3D structure exhibiting a different substantially consistent lateral cross-sectional shape (e.g., an ovular shape, an elliptical shape, a semicircular shape, a tombstone shape, a crescent shape, a triangular shape, a rectangular shape, a kite shape, an irregular shape, etc.) and substantially consistent lateral cross-sectional dimensions throughout the longitudinal thickness thereof, or may comprise a 3D structure exhibiting a variable lateral cross-sectional shape and variable lateral cross-sectional dimensions throughout the longitudinal thickness thereof.

The hard material 108 of the cutting table 104 may be formed of and include at least one polycrystalline material, such as a PCD material. For example, the hard material 108 may be formed from diamond particles (also known as "diamond grit") mutually bonded into a polycrystalline structure under high temperature, high pressure (HTHP) process conditions in the presence of at least one catalyst material (e.g., at least one Group VIII metal, such as one or more of cobalt, nickel, and iron; at least one alloy including a Group VIII metal, such as one or more of a cobalt-iron alloy, a cobalt-manganese alloy, a cobalt-nickel alloy, a cobalt-titanium alloy, a cobalt-nickel-vanadium alloy, an iron-nickel alloy, a iron-nickel-chromium alloy, an iron-manganese alloy, an iron-silicon alloy, a nickel-chromium alloy, and a nickel-manganese alloy; combinations thereof; etc.). The diamond particles may comprise one or more of natural diamond and synthetic diamond, and may include a monomodal distribution or a multimodal distribution of particle sizes. In additional embodiments, the hard material 108 is formed of and includes a different polycrystalline material, such as one or more of polycrystalline cubic boron nitride, a carbon nitride, and another hard material known in the art. Interstitial spaces between inter-bonded particles (e.g., inter-bonded diamond particles) of the hard material 108 may be at least partially filled with catalyst material (e.g., Co, Fe, Ni, another element from Group VIIIA of the Periodic Table of the Elements, alloys thereof, combinations thereof, etc.), and/or may be substantially free of catalyst material.

Figure 2:
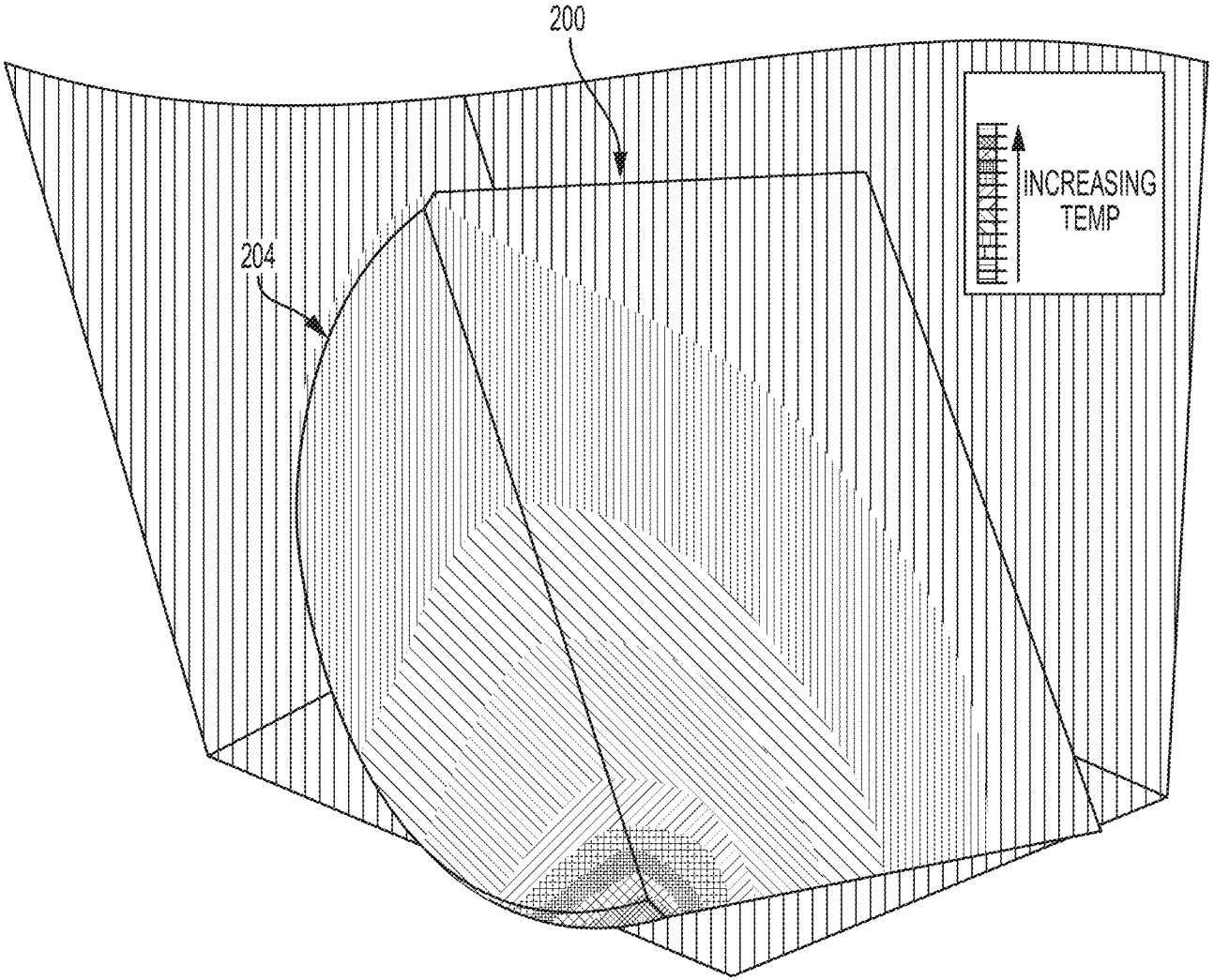
FIG. 2 is a cut-away perspective view illustrating an example of temperature distribution within a cutting element during use and operation of the cutting element.

The fluid flow pathway 110 of the cutting table 104 is configured to facilitate selective cooling of one or more internal regions of the hard material 108 adjacent thereto during use and operation of the cutting table 104. The fluid flow pathway 110 is configured to receive fluid (e.g., drilling fluid) proximate external surfaces (e.g., the side surface 112 of the cutting table 104, the cutting surface 114 of the cutting table 104) of the cutting element 100, and to flow the fluid therethrough to at least cool internal regions of the hard material 108 of the cutting table 104 projected (e.g., expected, predicted, anticipated) to exhibit relatively higher temperatures (e.g., temperatures greater than or equal to about 600° C., such as greater than or equal to about 700° C., greater than or equal to about 800° C., greater than or equal to about 900° C., greater than or equal to about 1000° C., greater than or equal to about 1100° C., or greater than or equal to about 1200° C.) during use and operation of the cutting element 100. The internal regions of the hard material 108 projected to exhibit relatively higher temperatures may be determined in advance of the use of the cutting element 100 based on conventional computer-numerical modelling data and/or based on data obtained through previous analysis of one or more actual (e.g., real) cutting table(s) having substantially similar peripheral geometric configuration(s) and material composition(s) to the cutting table 104. By way of non-limiting example, referring to FIG. 2, which illustrates a computer-numerically modelled temperature distribution within a simulated cutting element 200 including a simulated cutting table 204 as the simulated cutting element 200 engages a simulated subterranean formation, the fluid flow pathway 110 (FIG. 1A) of the cutting table 104 (FIG. 1A) may be configured to at least facilitate cooling of internal regions of the hard material 108 (FIG. 1A) of the cutting table 104 (FIG. 1A) corresponding to internal regions of the simulated cutting table 204 exhibiting relatively higher temperatures during the computer-numerically modeled use of the simulated cutting element 200 to engage the simulated subterranean formation. For example, in view of the computer-numerically modelled temperature distribution depicted in FIG. 2, the fluid flow pathway 110 (FIG. 1A) of the cutting table 104 (FIG. 1A) may be configured to facilitate cooling of internal regions of the hard material 108 (FIG. 1A) of the cutting table 104 (FIG. 1A) proximate a portion of the cutting edge 116 (FIG. 1A) of the cutting table 104 (FIG. 1A) expected to engage a subterranean formation during use and operation of the cutting element 100 (FIG. 1A).

With returned reference to FIG. 1A, the fluid flow pathway 110 of the cutting table 104 may exhibit ports 118 (e.g., inlet ports, outlet ports) in fluid communication with one another and disposed (e.g., located, positioned) at outermost boundaries of the hard material 108. At least one of the ports 118 may serve as an inlet for the fluid flow pathway 110, and at least one other of the ports 118 may serve as an outlet for the fluid flow pathway 110. The ports 118 may each individually be formed in at least one external surface (e.g., the side surface 112, the cutting surface 114) of the cutting table 104. By way of non-limiting example, as shown in FIG. 1A, the ports 118 of the fluid flow pathway 110 may each be formed in the side surface 112 of the cutting table 104. In additional embodiments, one or more of the ports 118 may be formed in the cutting surface 114 of the cutting table 104. At least one of the ports 118 may be configured to receive fluid (e.g., drilling fluid) proximate external surfaces of the cutting table 104, such that the fluid may flow through the fluid flow pathway 110 and remove heat from the hard material 108 of the cutting table 104 during use and operation of the cutting element 100. The resulting heated fluid may then exit at least one other of the ports 118 of the fluid flow pathway 110.

The position of one or more of the ports 118 of the fluid flow pathway 110 (e.g., at least one of the ports 118 serving as an inlet for the fluid flow pathway 110) may be selected at least partially based on a projected temperature distribution (e.g., as determined by conventional computer-numerical modelling data, and/or by previous analysis of another cutting table having a substantially similar peripheral geometric configuration and a substantially similar material composition) within the cutting table 104 during use and operation of the cutting element 100. The port(s) 118 may, for example, be positioned at one or more locations along an external surface (e.g., the side surface 112, the cutting surface 114) of the cutting table 104 permitting fluid (e.g., drilling fluid) to cool one or more relatively higher temperature regions of the hard material 108 prior to exiting the cutting table 104 at another port 118 of the fluid flow pathway 110. For example, the port(s) 118 of the fluid flow pathway 110 may be positioned proximate (e.g., near) a portion of the cutting edge 116 of the cutting table 104 expected to engage a subterranean formation during use and operation of the cutting element 100, such that fluid entering into the port 118 and flowing through the fluid flow pathway 110 cools regions of the hard material 108 proximate to the portion of the cutting edge 116. Positioning the port 118 of the fluid flow pathway 110 proximate portions of the cutting table 104 expected to engage a subterranean formation prior to other portions of the cutting table 104 may permit the fluid to cool relatively higher temperature regions of the hard material 108 prior to cooling relatively cooler temperature regions of the hard material 108 to enhance heat transfer within the cutting table 104.

Figure 3:
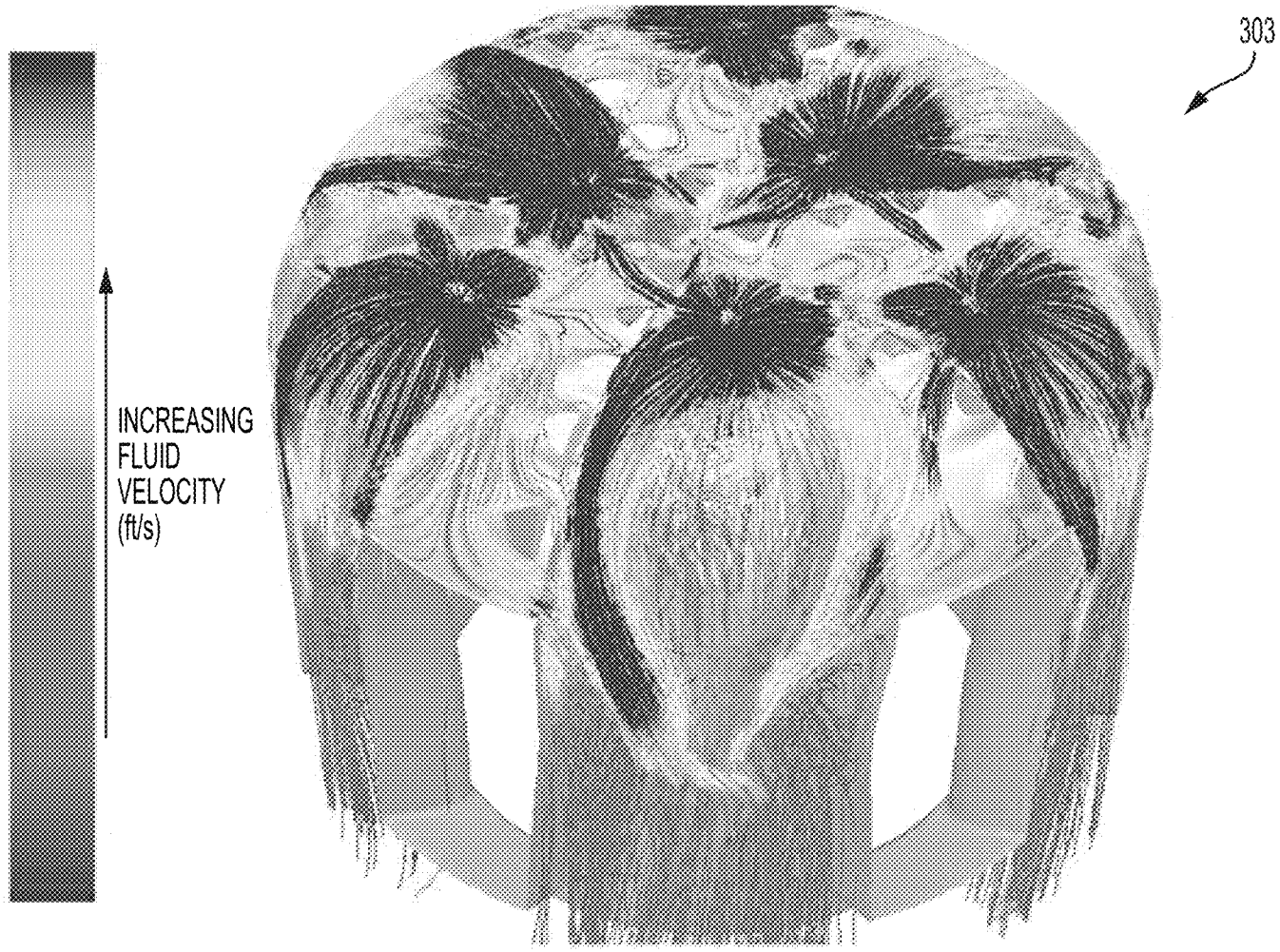
FIG. 3 is a perspective view illustrating an example of a fluid velocity profile of a fixed-cutter earth-boring rotary drill bit during use and operation of the fixed-cutter earth-boring rotary drill bit.

The position of one or more of the ports 118 of the fluid flow pathway 110 (e.g., at least one of the ports 118 serving as an inlet for the fluid flow pathway 110) may also be selected at least partially based on a projected fluid flow velocity profile of an earth-boring tool including the cutting element 100. For example, the port(s) 118 may be positioned at one or more locations along an external surface (e.g., the side surface 112, the cutting surface 114) of the cutting table 104 permitting relatively higher velocity currents of fluid (e.g., drilling fluid) to enter into the port(s) 118. The location of relatively higher velocity currents across the earth-boring tool may be determined in advance of the use of the earth-boring tool based on conventional computer-numerical modelling data and/or based on data obtained through previous analysis of one or more actual earth-boring tool(s) having substantially similar peripheral geometric configuration(s) to the earth-boring tool. By way of non-limiting example, referring to FIG. 3, which illustrates a computer-numerically modelled fluid velocity profile for a simulated fixed-cutter earth-boring rotary drill bit 303, one or more of the ports 118 (FIG. 1A) of the fluid flow pathway 110 (FIG. 1A) of the cutting table 104 (FIG. 1A) may be provided at one or more locations along an external surface (e.g., one or more of the side surface 112 and the cutting surface 114 shown in FIG. 1A) of the cutting table 104 (FIG. 1A) permitting the port(s) 118 (FIG. 1A) to interact with and receive relatively higher velocity current(s) of fluid corresponding to relatively higher velocity fluid current(s) observed in the computer-numerically modelled fluid velocity profile for the simulated fixed-cutter earth-boring rotary drill bit 303. Providing the port(s) 118 (FIG. 1A) of the fluid flow pathway 110 (FIG. 1A) in the path(s) of relatively higher velocity current(s) of drilling fluid may help propel (e.g., push, drive) the fluid through the fluid flow pathway 110 and enhance heat transfer within the cutting table 104.

With returned reference to FIG. 1A, the fluid flow pathway 110 may include any desired number of the ports 118. As shown in FIG. 1A, in some embodiments, the fluid flow pathway 110 includes four (4) ports 118, wherein one or more of the four (4) ports 118 serve as one or more inlets to the fluid flow pathway 110, and one or more other of the four (4) ports 118 serve as one or more outlets for the fluid flow pathway 110. Multiple (e.g., more than one) ports 118 may permit increased flow of fluid through the fluid flow pathway 110 during use and operation of the cutting element 100, and/or may permit rotation of the cutting element 100 to re-position one or more ports 118 as inlets to the fluid flow pathway 110 in the event of damage (e.g., wear) to the cutting element 100 and/or obstruction to (e.g., plugging of) one or more other ports 118 previously serving as inlets to the fluid flow pathway 110. In additional embodiments, the fluid flow pathway 110 may include a different number of ports 118, such as less than four (4) ports 118 (e.g., three (3) ports 118, two (2) ports 118), or greater than four (4) ports (e.g., five (5) ports 118, six (6) ports 118, greater than six (6) ports 118). Each of the ports 118 may exhibit substantially the same geometric configuration (e.g., substantially the same shape, and substantially the same dimensions), or at least one of the ports 118 may exhibit a different geometric configuration (e.g., a different shape, and/or one or more different dimensions) than at least one other of the ports 118.

The ports 118 of the fluid flow pathway 110 may be separated (e.g., circumferentially separated) from one another by intervening portions of the hard material 108. Each of the ports 118 may be circumferentially separated from each other of the ports 118 adjacent thereto by substantially the same distance (e.g., such that the ports 118 are substantially uniformly circumferentially spaced apart), or at least one port 118 may be circumferentially separated from at least one other port 118 adjacent thereto by a different distance than that between of the at least one port 118 and at least one additional port 118 circumferentially adjacent thereto (e.g., such that the ports 118 are non-uniformly circumferentially spaced). In some embodiments, the ports 118 are substantially uniformly circumferentially spaced. In additional embodiments, the ports 118 are non-uniformly circumferentially spaced.

Portions of the fluid flow pathway 110 intervening between the ports 118 may be substantially completely surrounded (e.g., covered, enveloped, encased) by the hard material 108. The fluid flow pathway 110 may comprise a tunnel (e.g., through opening, through via) embedded within and traversing through the hard material 108 of cutting table 104. Put another way, portions of the fluid flow pathway 110 intervening between the ports 118 may be positioned completely below the external surfaces (e.g., the side surface 112, the cutting surface 114) of the cutting table 104. For example, as shown in FIG. 1A, the fluid flow pathway 110 may be longitudinally offset (e.g., separated, distanced, spaced apart) from the cutting surface 114 of the cutting table 104, such that portions of the hard material 108 longitudinally intervene between the fluid flow pathway 110 and the cutting surface 114 of the cutting table 104. Accordingly, the cutting surface 114 of the cutting table 104 may be defined by uppermost longitudinal boundaries of the hard material 108, but not by the uppermost longitudinal boundaries of the fluid flow pathway 110. The fluid flow pathway 110 may be longitudinally offset from the cutting surface 114 of the cutting table 104 by any desired distance. In addition, each of the different lateral portions of the fluid flow pathway 110 may be longitudinally offset from the cutting surface 114 of the cutting table 104 by substantially the same distance (e.g., such that each of the different lateral portions of the fluid flow pathway 110 are substantially coplanar with one another), or at least one of the different lateral portions of the fluid flow pathway 110 may be longitudinally offset from the cutting surface 114 of the cutting table 104 by a different distance than at least one other of the different lateral portions of the fluid flow pathway 110 (e.g., such that at least some of the different lateral portions of the fluid flow pathway 110 are substantially non-coplanar with one another). In some embodiments, the fluid flow pathway 110 is longitudinally offset from both uppermost longitudinal boundaries (e.g., the cutting surface 114) and lowermost longitudinal boundaries of the cutting table 104 (e.g., the interface 106 between the cutting table 104 and the supporting substrate 102). In additional embodiments, the fluid flow pathway 110 is longitudinally offset from the uppermost longitudinal boundaries (e.g., the cutting surface 114) of the cutting table 104, but one or more portions of the fluid flow pathway 110 longitudinally extend to or beyond the lowermost longitudinal boundaries of the cutting table 104 (e.g., to or beyond the interface 106 between the cutting table 104 and the supporting substrate 102). In further embodiments, one or more portions of the fluid flow pathway 110 longitudinally extend to the uppermost longitudinal boundaries (e.g., the cutting surface 114) of the cutting table 104.

The fluid flow pathway 110 may extend in an at least partially (e.g., substantially) non-linear path within the hard material 108 of the cutting table 104. For example, as shown in FIG. 1B, the fluid flow pathway 110 may extend in a non-linear path including at least one arcuate section (e.g., at least one curved section). The arcuate section of the fluid flow pathway 110 may extend substantially parallel to the circumference (e.g., outermost lateral boundaries) of the cutting table 104. In some embodiments, the arcuate section of the fluid flow pathway 110 is substantially aligned with the circumferential curvature of the cutting table 104 at a particular radial position. In addition, as also shown in FIG. 1B, the fluid flow pathway 110 may include one or more linear sections in fluid communication with the arcuate section. The linear sections of the fluid flow pathway 110 may, for example, laterally inwardly extend from the ports 118 to the arcuate section of the fluid flow pathway 110. The linear sections of the fluid flow pathway 110 may intersect with the arcuate section of the fluid flow pathway 110. In additional embodiments, the fluid flow pathway 110 may extend in a different path (e.g., a substantially linear path; a different substantially non-linear path, such as a different arcuate path, an angled path, a jagged path, a sinusoidal path, a V-shaped path, a U-shaped path, an irregularly shaped path, combinations thereof, etc.) than that shown in FIGS. 1A and 1B. Non-limiting examples of such different paths are described in further detail below. The different path(s) of the fluid flow pathway 110 may, for example, be oriented and extend at least partially (e.g., substantially) non-parallel to the circumference of the cutting table 104.

The fluid flow pathway 110 may exhibit a cross-sectional geometric configuration (e.g., cross-sectional shape and cross-sectional dimensions) permitting the drilling fluid to enter into and cool the cutting table 104 during the use and operation of the cutting element 100. The fluid flow pathway 110 may, for example, exhibit one or more of a circular cross-sectional shape, a rectangular cross-sectional shape, an annular cross-sectional shape, a square cross-sectional shapes, a trapezoidal cross-sectional shape, a semicircular cross-sectional shape, a crescent cross-sectional shape, an ovular cross-sectional shape, ellipsoidal cross-sectional shape, a triangular cross-sectional shape, truncated versions thereof, and an irregular cross-sectional shape. In some embodiments, the fluid flow pathway 110 exhibits a substantially circular cross-sectional shape. In addition, the fluid flow pathway 110 may, for example, exhibit one or more cross-sectional dimensions (e.g., widths, heights) greater than or equal to about 0.5 mm, such as within a range of from about 0.5 mm to about 3 mm, within a range of from about 0.5 mm to about 2 mm, or within a range of from about 0.5 mm to about 1 mm. In some embodiments, the fluid flow pathway 110 exhibits a diameter of about 0.75 mm. All of the different portions of the fluid flow pathway 110 may exhibit substantially the same cross-sectional geometric configuration (e.g., substantially the same cross-sectional shape and substantially the same cross-sectional dimensions), or at least one portion of the fluid flow pathway 110 may exhibit a different geometric cross-sectional configuration (e.g., a different cross-sectional shape and/or one or more different cross-sectional dimensions) than at least one other section of the fluid flow pathway 110. In some embodiments, each of the different portions of fluid flow pathway 110 exhibits substantially the same cross-sectional geometric configuration.

The cutting table 104 may include any quantity and any distribution of fluid flow pathway(s) 110 facilitating a desired and predetermined amount of cooling of the cutting table 104 during use and operation thereof, while also facilitating desired and predetermined structural integrity of the cutting table 104 during the use and operation thereof. The fluid flow pathway(s) 110 may occupy less than or equal to about fifty (50) percent (e.g., less than or equal to about forty (40) percent, less than or equal to about thirty (30) percent, less than or equal to about twenty (20) percent, less than or equal to about ten (10) percent, or less than or equal to about five (5) percent) of the volume of the cutting table 104. The quantity and the distribution of the fluid flow pathway(s) 110 may at least partially depend on the configurations (e.g., material compositions, material distributions, shapes, sizes, orientations, arrangements, etc.) of the hard material 108 and the fluid flow pathway(s) 110. In some embodiments, the cutting table 104 includes a single (e.g., only one) fluid flow pathway 110 within the hard material 108. In additional embodiments, the cutting table 104 includes greater than or equal to two (2) fluid flow pathways 110. If the cutting table 104 includes multiple fluid flow pathways 110, the fluid flow pathways 110 may be discrete (e.g., separate) from and discontinuous with one another within the hard material 108. In addition, if the cutting table 104 includes multiple fluid flow pathways 110, the fluid flow pathways 110 may be symmetrically distributed within the hard material 108 of the cutting table 104, or may be asymmetrically distributed within the hard material 108 of the cutting table 104.

The cutting element 100 may be formed by providing the supporting substrate 102 and a hard material powder (e.g., diamond powder) having one or more rhenium (Re)-containing structures (e.g., Re-containing wires) disposed (e.g., embedded) therein into a container, subjecting the supporting substrate 102 and the hard material powder to high temperature/high pressure (HTHP) processing to form the hard material 108, and then removing (e.g., leaching) the Re-containing structures from the hard material 108 to form the cutting table 104 including the fluid flow pathway 110 therein. The HTHP process may include subjecting the hard material powder, the Re-containing structures, and the supporting substrate 102 to elevated temperatures and pressures in a heated press for a sufficient time to inter-bond discrete hard material particles of the hard material powder. Although the exact operating parameters of HTHP processes will vary depending on the particular compositions and quantities of the various materials being sintered, pressures in the heated press may be greater than or equal to about 5.0 GPa (e.g., greater than or equal to about 6.5 gigapascals (GPa), such as greater than or equal to about 6.7 GPa) and temperatures may be greater than or equal to about 1,400° C. Furthermore, the materials and structures being sintered may be held at such temperatures and pressures for a time period between about 30 seconds and about 20 minutes. In addition, the Re-containing structures may, for example, be removed by exposing the hard material 108 and the Re-containing structures to a leaching agent for a sufficient period of time to remove the Re-containing structures. Suitable leaching agents are known in the art and described more fully in, for example, U.S. Pat. No. 5,127,923 to Bunting et al. (issued Jul. 7, 1992), and U.S. Pat. No. 4,224,380 to Bovenkerk et al. (issued Sep. 23, 1980), the disclosure of each of which is incorporated herein in its entirety by this reference. By way of non-limiting example, at least one of aqua regia (i.e., a mixture of concentrated nitric acid and concentrated hydrochloric acid), boiling hydrochloric acid, and boiling hydrofluoric acid may employed as a leaching agent. In some embodiments, the leaching agent may comprise hydrochloric acid at a temperature greater than or equal to about 110° C. The leaching agent may be provided in contact with the hard material 108 and the Re-containing structures for a period of from about 30 minutes to about 60 hours.

As previously discussed, while FIGS. 1A and 1B depict a particular configuration of the cutting element 100, including a particular configuration of the cutting table 104 thereof (e.g., including particular configurations of the hard material 108 and the fluid flow pathway 110), different configurations may be employed. By way of non-limiting example, in accordance with additional embodiments of the disclosure, FIGS. 4A through 8B show perspective (i.e., FIGS. 4A, 5A, 6A, 7A, and 8A), transverse cross-sectional (i.e., FIGS. 4B and 5B), and top-down (i.e., FIGS. 6B, 7B, and 8B) views of cutting elements exhibiting different configurations than that of the cutting element 100 shown in FIGS. 1A and 1B. Throughout the remaining description and the accompanying figures, functionally similar features (e.g., structures) are referred to with similar reference numerals incremented by 100. To avoid repetition, not all features shown in FIGS. 4A through 8B are described in detail herein. Rather, unless described otherwise below, a feature designated by a reference numeral that is a 100 increment of the reference numeral of a previously-described feature (whether the previously-described feature is first described before the present paragraph, or is first described after the present paragraph) will be understood to be substantially similar to the previously-described feature.

Figure 4B:
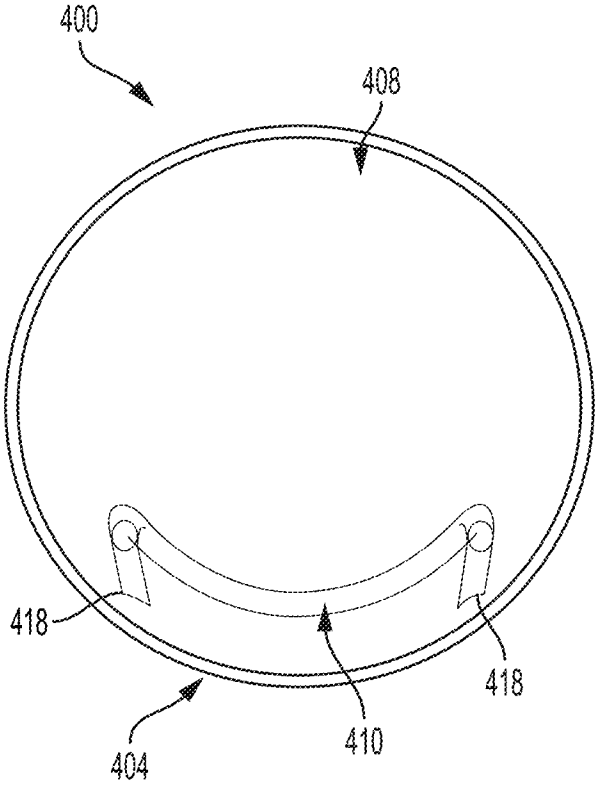
FIGS. 4A and 4B are perspective (FIG. 4A) and cross-sectional (FIG. 4B) views of an additional cutting element configuration, in accordance with additional embodiments of the disclosure.
Figure 4A:
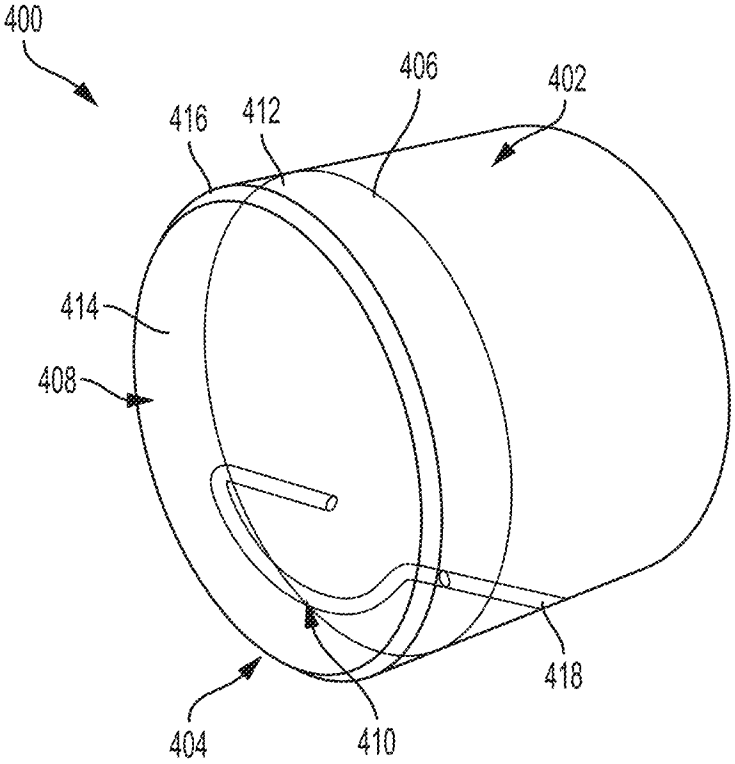

FIG. 4A illustrates a simplified cross-sectional view of a cutting element 400, in accordance with another embodiment of the disclosure. As shown in FIG. 4A, the cutting element 400 includes a supporting substrate 402, and a cutting table 404 including a hard material 408 attached to the supporting substrate 402 at an interface 406. The cutting element 400 also includes at least one fluid flow pathway 410 embedded within the supporting substrate 402 and the cutting table 404. The fluid flow pathway 410 may extend (e.g., laterally extend, longitudinally extend) into the supporting substrate 402 and the cutting table 404 from ports 418 in one or more external surfaces of the cutting element 400. The ports 418 may serve as one or more inlets and one or more outlets for the fluid flow pathway 410. As shown in FIG. 4A, in some embodiments, one or more of the ports 418 are located in a side surface of the supporting substrate 402. In additional embodiments, one or more of the ports 418 are located in a different external surface of the cutting element 400, such as a side surface 412 of the cutting table 404 and/or a cutting surface 414 of the cutting table 404. The positions of port(s) 418 serving as one or more inlets to the fluid flow pathway 410 may be selected based on a projected temperature distribution within the hard material 408 of the cutting table 404 during use and operation thereof, and based on a projected fluid velocity profile of an earth-boring tool employing the cutting element 400 during use and operation of the earth-boring tool, in manners substantially similar to those previously described with reference to FIGS. 1A through 3. As shown in FIG. 4A, the fluid flow pathway 410 may be longitudinally offset from the cutting surface 414 of the cutting table 404 (e.g., such that portions of the hard material 408 longitudinally intervene between the fluid flow pathway 410 and the cutting surface 414), and may extend in an at least partially non-linear path (e.g., an at least partially arcuate path) through internal regions of the cutting element 400 expected to exhibit relatively higher temperatures during use and operation of the cutting element 400 (e.g., internal regions of the cutting table 404 proximate a portion of the cutting edge 416 to engage a subterranean formation during use and operation of the cutting element 400). In some embodiments, a majority (e.g., greater than fifty (50) percent, such as greater than or equal to about sixty (60) percent, greater than or equal to about seventy-five (75) percent, or greater than or equal to about ninety (90) percent) of the fluid flow pathway 410 is located within internal regions of the cutting element 400 expected (e.g., as determined by conventional computer-numerical modeling data, and/or by previous analysis of another cutting element having a substantially similar peripheral geometric configuration and a substantially similar material composition) to exhibit a temperature greater than or equal to about 600° C. (e.g., greater than or equal to about 700° C., greater than or equal to about 800° C., greater than or equal to about 900° C., greater than or equal to about 1000° C., or greater than or equal to about 1100° C.) during use and operation of cutting element 400. The cutting element 400, including the cutting table 404 and the fluid flow pathway 410 thereof, may be formed using a process substantially similar to that previously described with respect to the formation of the cutting element 100 (FIGS. 1A and 1B). FIG. 4B is a transverse cross-sectional view of the cutting element 400 shown in FIG. 4A taken through the cutting table 404 thereof.

Figure 5B:
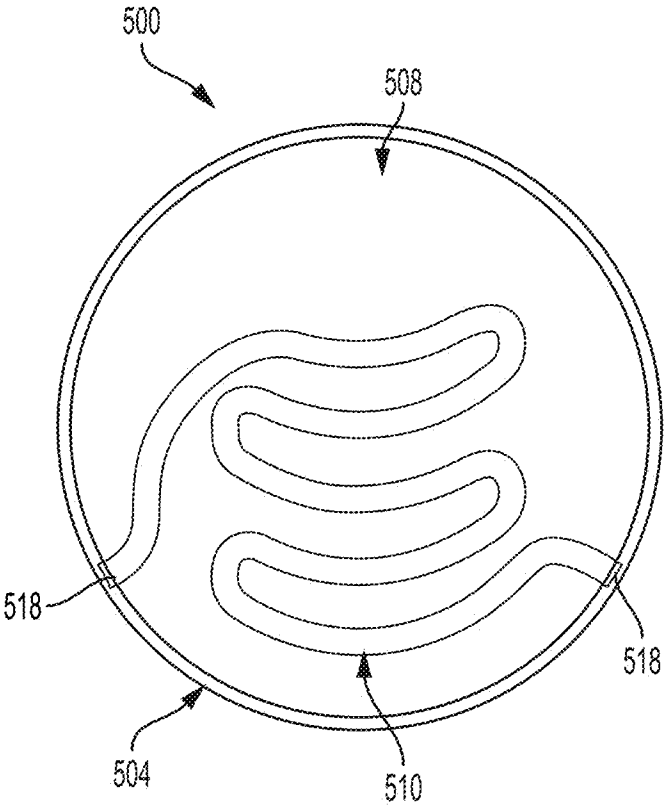
FIGS. 5A and 5B are perspective (FIG. 5A) and cross-sectional (FIG. 5B) views of an additional cutting element configuration, in accordance with additional embodiments of the disclosure.
Figure 5A:
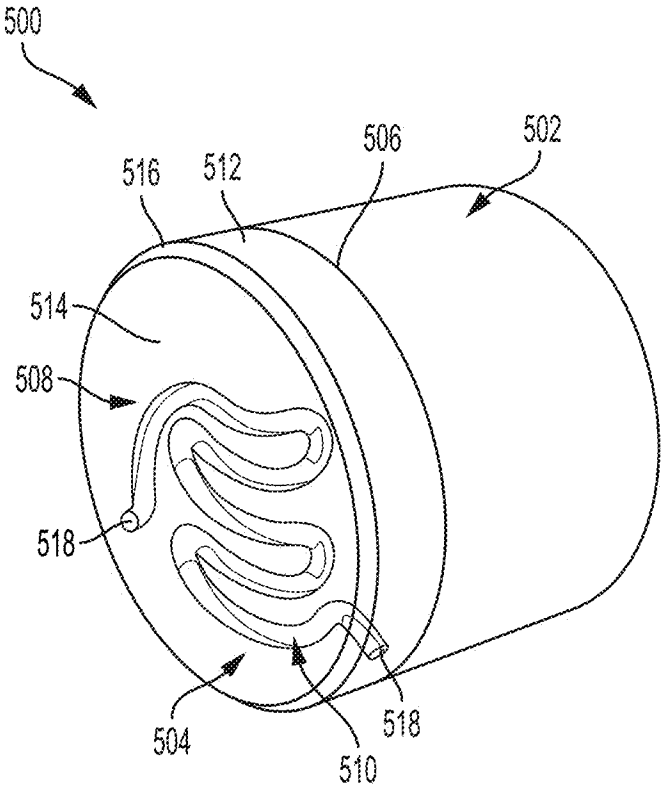

FIG. 5A illustrates a simplified cross-sectional view of a cutting element 500, in accordance with another embodiment of the disclosure. As shown in FIG. 5A, the cutting element 500 includes a supporting substrate 502, and a cutting table 504 including a hard material 508 attached to the supporting substrate 502 at an interface 506. The cutting element 500 also includes at least one fluid flow pathway 510 embedded within the hard material 508 of the cutting table 504. The fluid flow pathway 510 extends into the cutting table 504 from ports 518 in one or more external surfaces (e.g., a side surface 512, a cutting surface 514) of the cutting table 504, and the ports 518 may serve as one or more inlets and one or more outlets for the fluid flow pathway 510. As shown in FIG. 5A, in some embodiments, the ports 518 are located in a side surface 512 of the cutting table 504. The positions of port(s) 518 serving as one or more inlets to the fluid flow pathway 510 may be selected based on a projected temperature distribution within the hard material 508 of the cutting table 504 during use and operation thereof, and based on a projected fluid velocity profile of an earth-boring tool employing the cutting element 500 during use and operation of the earth-boring tool, in manners substantially similar to those previously described with reference to FIGS. 1A through 3. As shown in FIG. 5A, the fluid flow pathway 510 may be longitudinally offset from the cutting surface 514 of the cutting table 504 (e.g., such that portions of the hard material 508 longitudinally intervene between the fluid flow pathway 510 and the cutting surface 514), and may extend in an at least partially non-linear path through the hard material 508 of the cutting table 504. The at least partially non-linear path may, for example, exhibit a section including interconnected arcuate paths that laterally wind (e.g., oscillate) back and forth through a portion of the hard material 508. By way of non-limiting example, the section may exhibit one or more of a generally sinusoidal shape and a generally zig-zag shape within the hard material 508. The cutting element 500, including the cutting table 504 and the fluid flow pathway 510 thereof, may be formed using a process substantially similar to that previously described with respect to the formation of the cutting element 100 (FIGS. 1A and 1B). FIG. 5B is a transverse cross-sectional view of the cutting element 500 shown in FIG. 5A taken through the cutting table 504 thereof.

Figure 6B:
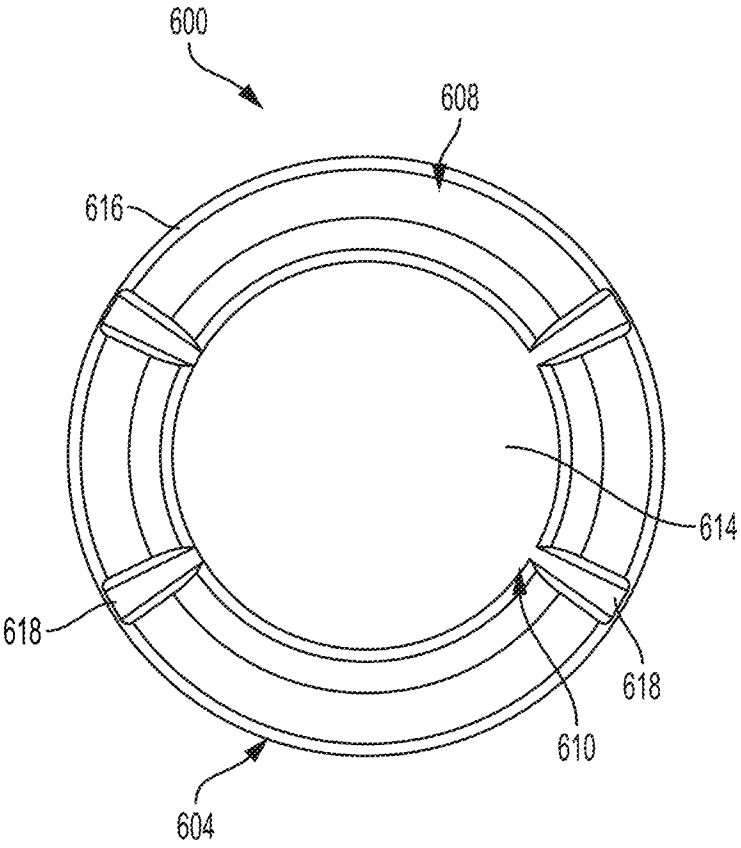
FIGS. 6A through 6E are perspective (FIG. 6A), top-down (FIG. 6B), partial perspective (FIGS. 6C and 6D), and partial top down (FIG. 6E) views of additional cutting element configurations, in accordance with additional embodiments of the disclosure.
Figure 6A:
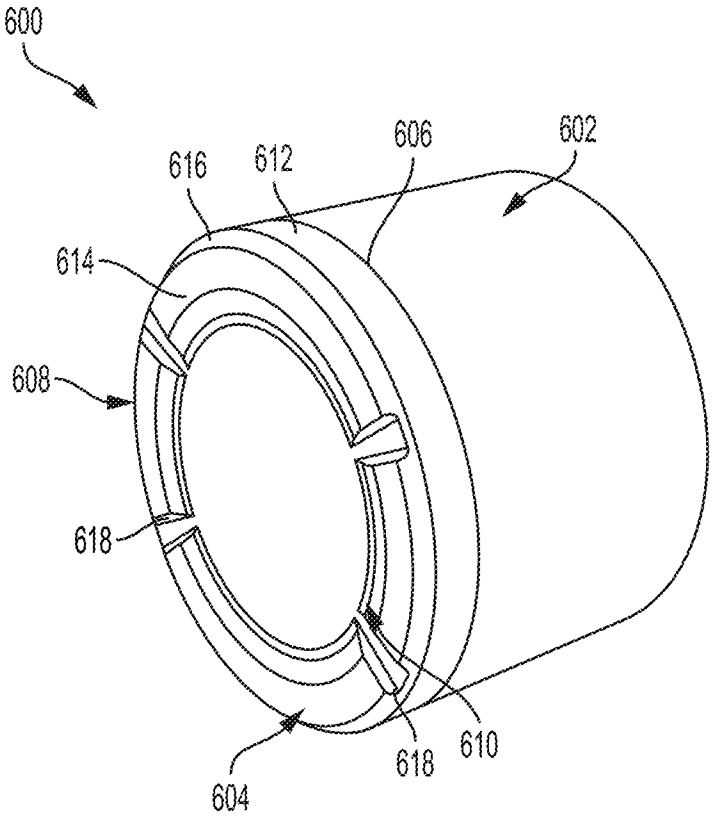

FIG. 6A illustrates a simplified cross-sectional view of a cutting element 600, in accordance with another embodiment of the disclosure. As shown in FIG. 6A, the cutting element 600 includes a supporting substrate 602, and a cutting table 604 attached to the supporting substrate 602 at an interface 606. The cutting table 604 includes a hard material 608 and at least one fluid flow pathway 610 extending into the hard material 608. As shown in FIG. 6A, the fluid flow pathway 610 longitudinally extends into the hard material 608 from an uppermost longitudinal boundary of the hard material 608, and laterally extends into the hard material 608 from an outermost lateral boundary of the hard material 608. Uppermost longitudinal boundaries of the fluid flow pathway 610 may be substantially coplanar with uppermost longitudinal boundaries of the hard material 608, such that portions of the hard material 608 do not longitudinally intervene between the fluid flow pathway 610 and the cutting surface 614 of the cutting table 604. Accordingly, the cutting surface 614 of the cutting table 604 may be at least partially defined by the fluid flow pathway 610. The fluid flow pathway 610 may define recessed regions of the cutting surface 614, and portions of the hard material 608 laterally adjacent the fluid flow pathway 610 may define elevated regions of the cutting surface 614. FIG. 6B is a top-down view of the cutting element 600 shown in FIG. 6A.

As shown in FIG. 6A, the fluid flow pathway 610 of the cutting element 600 may be similar to that of the fluid flow pathway 110 of the cutting element 100 previously described herein with reference to FIGS. 1A and 1B, except that the fluid flow pathway 610 substantially affects the topography of the cutting surface 614 of the cutting table 604 since the hard material 608 does not substantially longitudinally overly (e.g., cover) the fluid flow pathway 610. The fluid flow pathway 610 may comprise a trench (e.g., a blind opening, a blind via) extending into the hard material 608 of the cutting table 604. The fluid flow pathway 610 is configured to receive fluid (e.g., drilling fluid, such as drilling mud) during use and operation of the cutting element 600, and to flow the fluid therethrough to at least cool regions of the hard material 608 expected (e.g., as determined by conventional computer-numerical modeling data, and/or by previous analysis of another cutting element having a substantially similar peripheral geometric configuration and a substantially similar material composition) to exhibit relatively higher temperatures (e.g., temperatures greater than or equal to about 600° C.) during use and operation of the cutting element 600. Accordingly, the configuration of the fluid flow pathway 610, including the positions of one or more ports 618 (e.g., inlet ports, outlet ports) thereof, may be selected based on a projected temperature distribution within the hard material 608 of the cutting table 604 during the use and operation thereof, in a manner substantially similar to that previously discussed with respect to FIGS. 1A through 2.

The configuration of the fluid flow pathway 610, including the positions of one or more ports 618 (e.g., inlet ports, outlet ports) thereof, may also be selected based on a projected fluid flow velocity profile of an earth-boring tool including the cutting element 600. For example, one or more ports 618 serving as inlets to the fluid flow pathway 610 may be positioned to permit one or more relatively higher velocity currents of fluid (e.g., drilling fluid) to enter into the port(s) 618 (and, hence, the fluid flow pathway 610). The location of relatively higher velocity currents of fluid across the earth-boring tool may be determined in advance of the use of the earth-boring tool based on conventional computer-numerical modelling data and/or based on data obtained through previous analysis of one or more actual earth-boring tool(s) having substantially similar peripheral geometric configuration(s) to the earth-boring tool, in a manner substantially similar to that previously discussed with respect to FIGS. 1A and 3. Providing one or more of the ports 618 of the fluid flow pathway 610 in the path(s) of one or more relatively higher velocity currents of drilling fluid may help propel (e.g., push, drive) the fluid through the fluid flow pathway 610 and enhance the cooling of the cutting table 604. In addition, providing one or more of the ports 618 of the fluid flow pathway 610 in the path(s) of one or more relatively higher velocity currents of fluid may also modify vectors (e.g., paths, directions, courses) of the higher velocity currents of the fluid in manners permitting the higher velocity currents to direct (e.g., propel, push) cuttings formed by engaging (e.g., shearing, gouging) a subterranean formation with the cutting element 600 away from the cutting table 604 thereof. Directing the cuttings away from the cutting table 604 may reduce friction against the external surfaces (e.g., the cutting surface 614, the side surface 612) and edges (e.g., the cutting edge 616) of the cutting table 604 to reduce wear to and heat generation within the cutting table 604.

The fluid flow pathway 610 may exhibit any shapes (e.g., path shapes, cross-sectional shapes) and sizes (widths, depths) permitting desired and predetermined cooling of the cutting table 604 using the fluid (e.g., drilling fluid), and permitting desired and predetermined modification of vectors of currents (e.g., high velocity currents) of the fluid. As shown in FIG. 6A, in some embodiments, the fluid flow pathway 610 extends in at least partially (e.g., substantially) non-linear path including at least one arcuate section (e.g., at least one curved section), and linear sections laterally inwardly extending from the ports 618 to the arcuate section. Edges of the hard material 608 defining the fluid flow pathway 610 may be chamfered, radiused, and/or sharp (e.g., non-chamfered and non-radiused). In addition, widths and depths of different sections of the fluid flow pathway 610 (e.g., widths and depths of the arcuate section, widths and depths of the linear sections) may individually be substantially uniform (e.g., non-variable) or may be at least partially non-uniform (e.g., at least partially variable). As shown in FIG. 6A, in some embodiments, edges of hard material 608 defining the fluid flow pathway 610 are chamfered, different sections of the fluid flow pathway 610 longitudinally extend to substantially the same depth in the hard material 608, and at least the linear sections of the fluid flow pathway 610 exhibit variable width (e.g., widths of the linear sections decrease in directions extending inward from the side surface 612 of the cutting table 604). In additional embodiments, the edges of hard material 608 defining the fluid flow pathway 610 may exhibit a different configuration (e.g., a non-chamfered configuration, a radiused configuration, a combination of a radiused configuration and a chamfered configuration, etc.), one or more different sections of the fluid flow pathway 610 may longitudinally extend to different depths in the hard material 608, and/or one or more sections of the fluid flow pathway 610 exhibit different widths than those depicted in FIGS. 6A and 6B (e.g., widths of the linear sections may increase in directions extending inward from the side surface 612 of the cutting table 604).

Figure 6D:
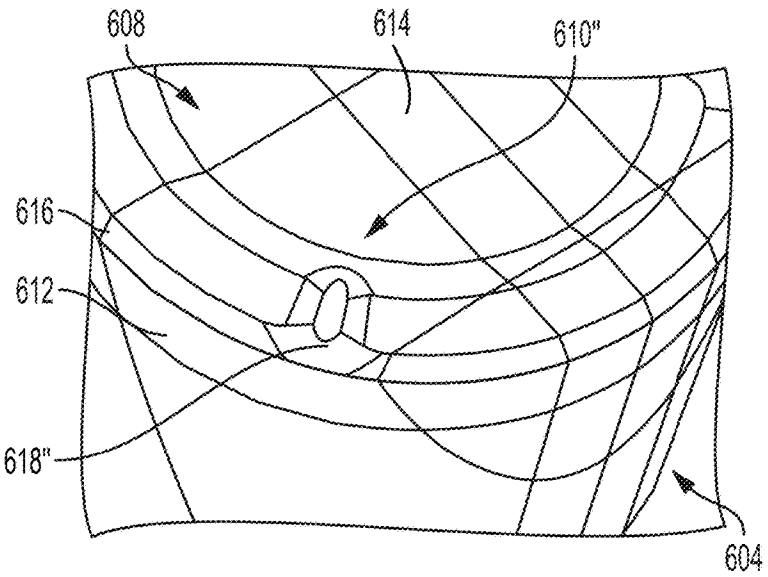
Figure 6C:
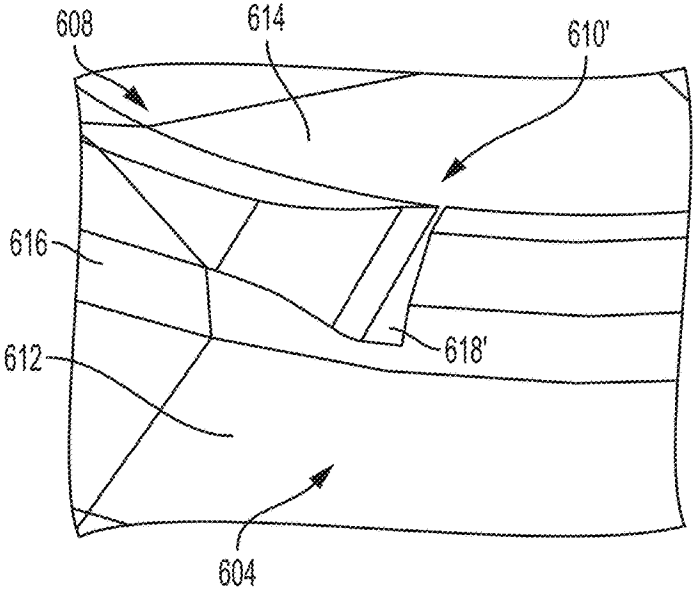
Figure 6E:
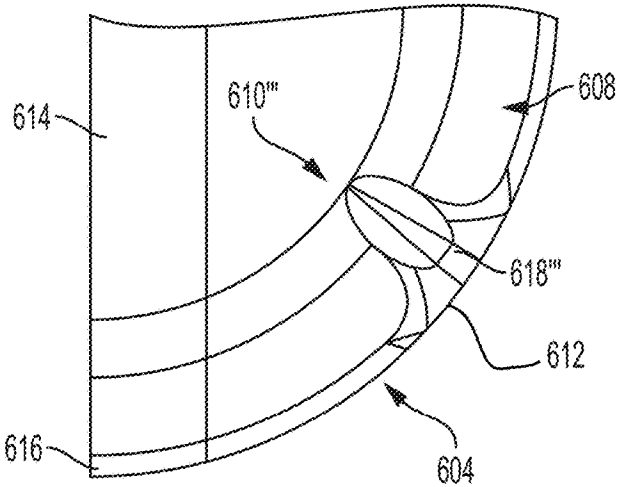

The configuration of the fluid flow pathway 610 may also reduce stresses during the attachment of the cutting element 600 to an earth-boring tool, and/or during use and operation of the cutting element 600. For example, edges of the hard material 608 defining one or more portions of the fluid flow pathway 610 may be sized and shaped to reduce stresses in the cutting table 604. As shown in FIGS. 6A and 6B, in some embodiments, one or more of the edges of the hard material 608 defining the fluid flow pathway 610, including one or more edges of the hard material 608 defining the ports 618, are chamfered (e.g., beveled) to reduce stresses in the cutting table 604. In additional embodiments, the one or more of the edges of the hard material 608 may be configured differently to reduced stresses in the cutting table 604. By way of non-limiting example, FIGS. 6C through 6E show partial perspective (FIGS. 6C and 6D) and partial top-down views of alternative configurations of the flow pathway 610 and the ports 618 for reducing stresses in the cutting table 604 during the attachment of the cutting element 600 to an earth-boring tool and/or during use and operation of the cutting element 600. As shown in FIG. 6C, in accordance with an additional embodiment of the disclosure, edges of the hard material 608 defining the fluid flow pathway 610' along the cutting surface 614 of the cutting table 604, such as edges partially defining the ports 618', may be outwardly expanded and angled (and/or radiused) to provide a smooth and non-aggressive lead into the cutting surface 614 from the fluid flow pathway 610'. As shown in FIG. 6D, in accordance with a further embodiment of the disclosure, edges of the hard material 608 defining the fluid flow pathway 610" along the side surface 612, the cutting surface 614, and the cutting edge 616 of the cutting table 604, such as edges partially defining the ports 618", may be outwardly expanded and angled (and/or radiused) to provide a smooth and non-aggressive lead into the side surface 612, the cutting surface 614, and the cutting edge 616 from the fluid flow pathway 610". As shown in FIG. 6E, in accordance with another embodiment of the disclosure, edges of the hard material 608 defining the fluid flow pathway 610'" along the side surface 612 and the cutting edge 616 of the cutting table 604, such as edges partially defining the ports 618'", may be outwardly expanded and angled (and/or radiused) to provide a smooth and non-aggressive lead into the side surface 612 and the cutting edge 616 from the fluid flow pathway 610'".

With returned reference to FIG. 6A, the fluid flow pathway 610 may be formed in the hard material 608 of the cutting table 604 by subjecting the hard material 608 to at least one material removal process, such as one or more of a laser etching process, an electric discharge machining (EDM) process, another etching process, and another machining process. By way of non-limiting example, the fluid flow pathway 610 may be formed in the hard material 608 through at least one laser etching process such as, for example, a laser etching process described in U.S. Pat. No. 9,259,803, filed Nov. 5, 2008, issued Feb. 16, 2016, and assigned to the assignee of the disclosure, the entire disclosure of which is hereby incorporated herein by this reference. In some embodiments, the fluid flow pathway 610 is laser etched (e.g., laser cut) into the hard material 608 of cutting table 604. In additional embodiments, the fluid flow pathway 610 is formed (e.g., pressed, molded, etc.) into a material (e.g., a hard material powder) forming the hard material 608 during the formation of the cutting table 604. The fluid flow pathway 610 may be formed in the hard material 608 of the cutting table 604 prior to, during, or after attachment of the cutting table 604 to the supporting substrate 602.

Figure 7B:
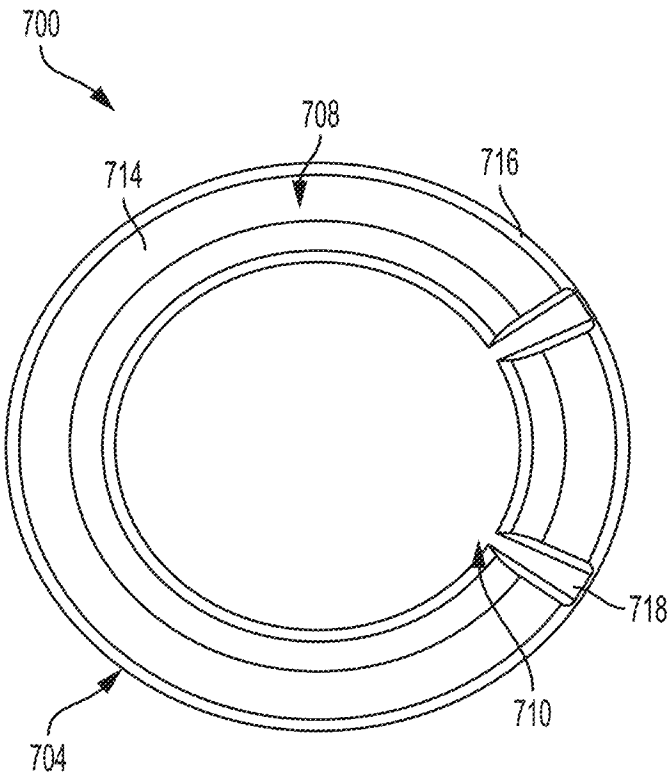
FIGS. 7A and 7B are perspective (FIG. 7A) and top-down (FIG. 7B) views of an additional cutting element configuration, in accordance with additional embodiments of the disclosure.
Figure 7A:
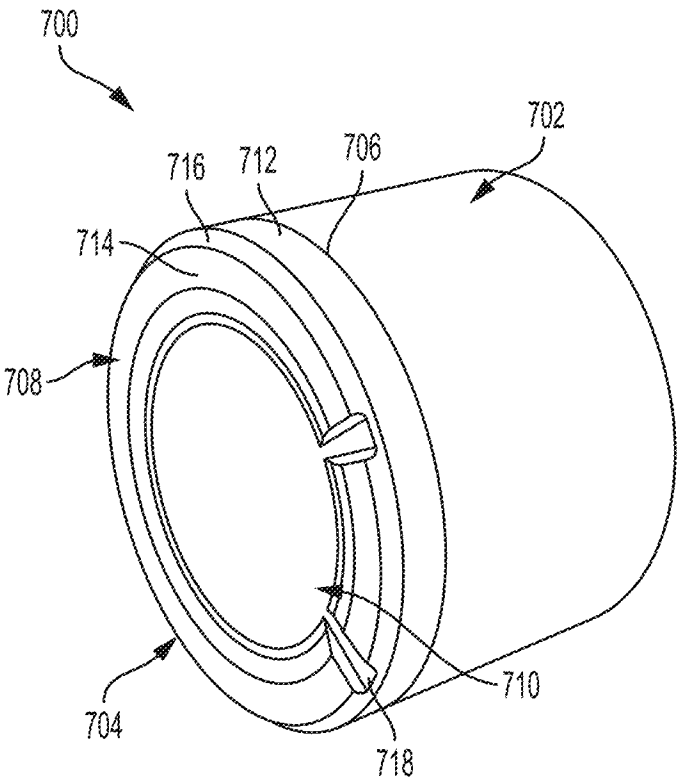

FIG. 7A illustrates a simplified cross-sectional view of a cutting element 700, in accordance with another embodiment of the disclosure. As shown in FIG. 7A, the cutting element 700 includes a supporting substrate 702, and a cutting table 704 attached to the supporting substrate 702 at an interface 706. The cutting table 704 includes a hard material 708 and at least one fluid flow pathway 710 extending into the hard material 708. The fluid flow pathway 710 may comprise a trench (e.g., a blind opening, a blind via) longitudinally extending into the hard material 708 of the cutting table 704 from an uppermost longitudinal boundary of the hard material 708. As shown in FIG. 7A, the fluid flow pathway 710 may be substantially similar to the fluid flow pathway 610 of the cutting element 600 previously described with reference to FIGS. 6A and 6B, except that the fluid flow pathway 710 may exhibit fewer ports 718 (e.g., inlet ports, outlet ports) and, hence, fewer linear sections laterally inwardly extending from the ports 718 to an arcuate section of the fluid flow pathway 710. The cutting element 700, including the cutting table 704 and the fluid flow pathway 710 thereof, may be formed using a process substantially similar to that previously described with respect to the formation of the cutting element 600 (FIGS. 6A and 6B). FIG. 7B is a top-down view of the cutting element 700 shown in FIG. 7A.

Figure 8B:
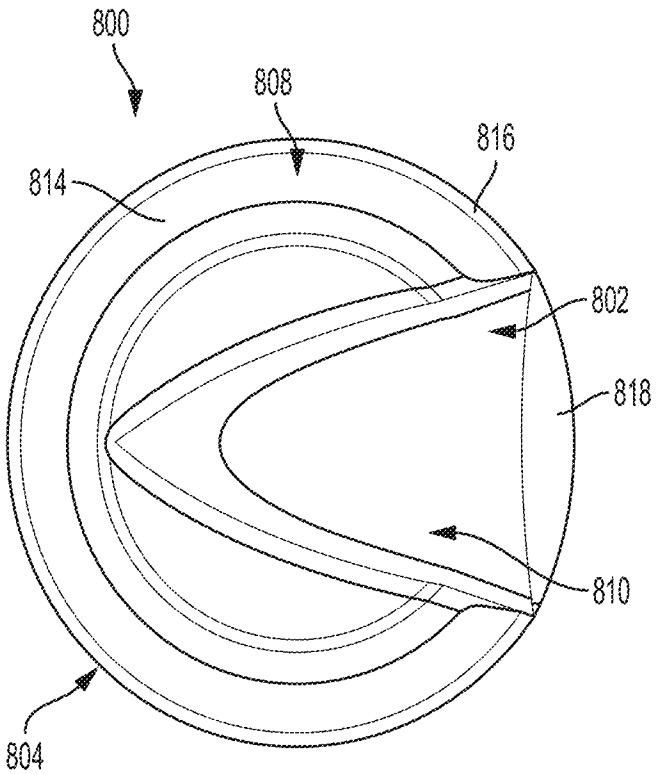
FIGS. 8A and 8B are perspective (FIG. 8A) and top-down (FIG. 8B) views of an additional cutting element configuration, in accordance with additional embodiments of the disclosure.
Figure 8A:
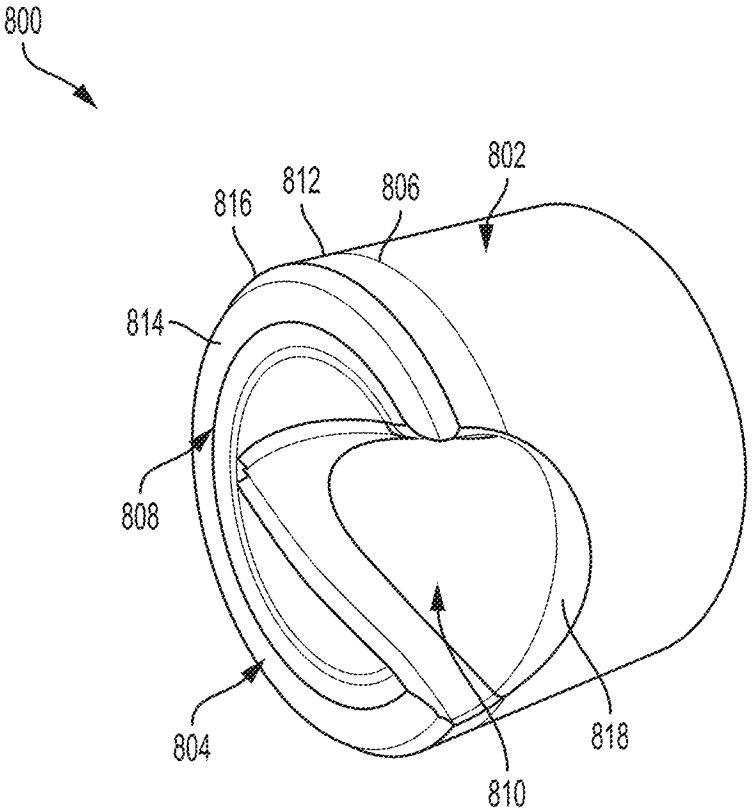

FIG. 8A illustrates a simplified cross-sectional view of a cutting element 800, in accordance with another embodiment of the disclosure. As shown in FIG. 8A, the cutting element 800 includes a supporting substrate 802, and a cutting table 804 including a hard material 808 attached to the supporting substrate 802 at an interface 806. The cutting element 800 also includes at least one fluid flow pathway 810 longitudinally extending through the cutting table 804 and into the supporting substrate 802. The fluid flow pathway 810 may have a wedge shape exhibiting variable (e.g., non-uniform, non-constant) width and variable depth. For example, each of a width and a depth of the fluid flow pathway 810 may decrease in a direction extending laterally inward from a port 818 in side surfaces of the cutting element 800. The configuration of the fluid flow pathway 810 may permit desired and predetermined cooling of the cutting element 800 using a fluid (e.g., drilling fluid) during use and operation of the cutting element 800, and may also permit desired and predetermined modification of vectors of currents (e.g., high velocity currents) of the fluid. The wedge shape of the fluid flow pathway 810 may substantially direct (e.g., propel, push) cuttings formed by engaging (e.g., shearing, gouging) a subterranean formation with the cutting element 800 away from the cutting table 804 thereof. In additional embodiments, the fluid flow pathway 810 may exhibit one or more of a different endpoint (e.g., an endpoint more laterally proximate a center of the cutting table 804), different depth(s) (e.g., a shallower maximum depth, such as a maximum depth longitudinally terminating within the cutting table 804; a deeper maximum depth, such as a maximum depth longitudinally extending deeper into the supporting substrate 802; a non-variable depth), and different width(s) (e.g., a narrower maximum width, a wider maximum width, a non-variable width) than those depicted in FIG. 8A. The cutting element 800, including the cutting table 804 and the fluid flow pathway 810 thereof, may be formed using a process substantially similar to that previously described with respect to the formation of the cutting element 600 (FIGS. 6A and 6B). FIG. 8B is a top-down view of the cutting element 800 shown in FIG. 8A.

Figure 9:
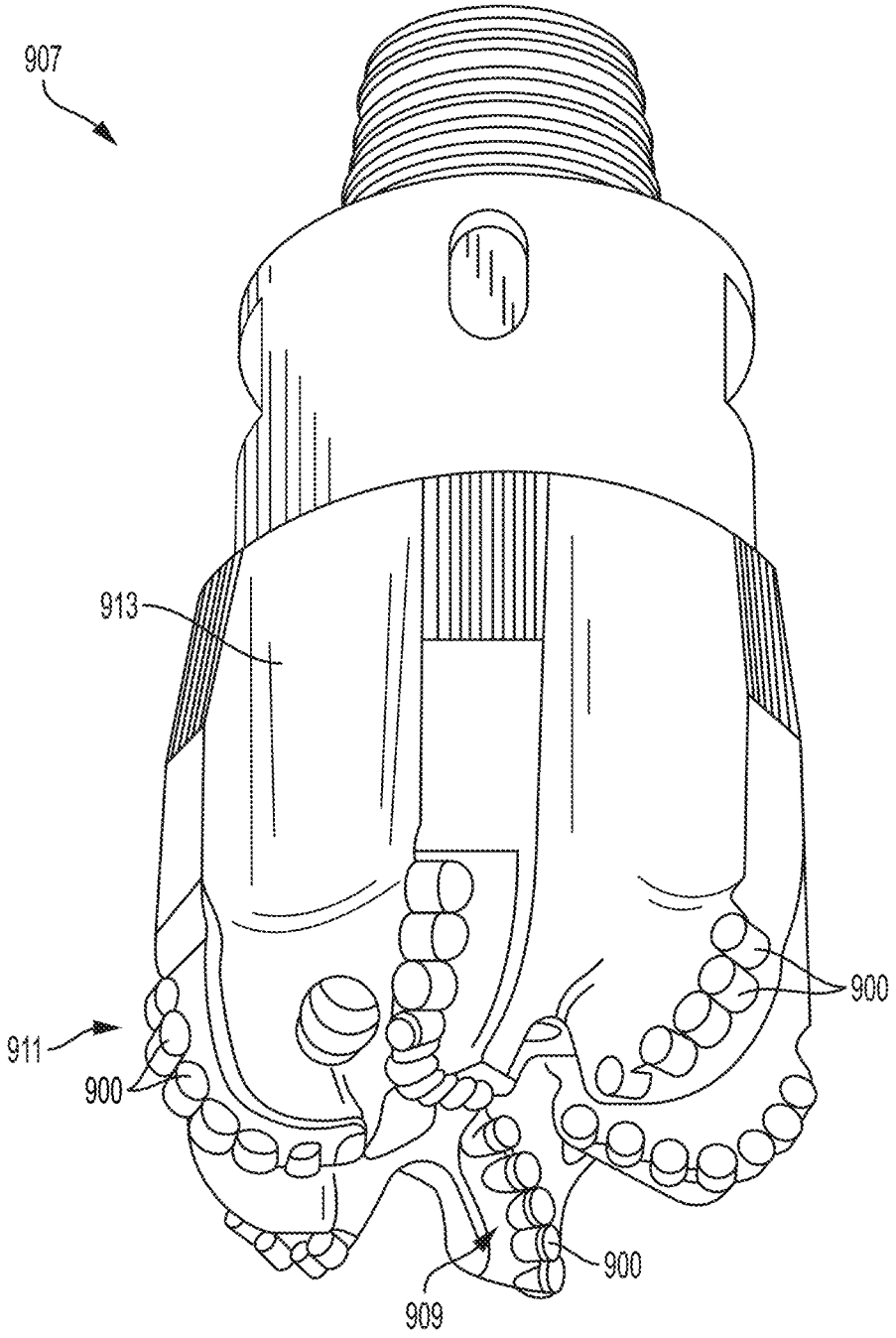
FIG. 9 is a perspective view of a fixed-cutter earth-boring rotary drill bit, in accordance with embodiments of the disclosure.

Cutting elements (e.g., the cutting elements 100, 400, 500, 600, 700, 800) according to embodiments of the disclosure may be included in earth-boring tools of the disclosure. As a non-limiting example, FIG. 9 illustrates a rotary drill bit 907 (e.g., a fixed-cutter rotary drill bit) including cutting elements 900 secured thereto. The cutting elements 900 may, for example, be secured (e.g., welded, brazed, etc.) within pockets 909 in one or more blades 911 of a bit body 913 of the rotary drill bit 907. The cutting elements 900 may be substantially similar to one or more of the cutting elements 100, 400, 500, 600, 700, 800 previously described herein. At least in embodiments wherein cutting table(s) of one or more of the cutting elements 900 exhibit fluid flow pathway(s) partially defining cutting surface(s) of the cutting table(s) (e.g., such as the cutting tables 604, 704, 804 of the cutting elements 600, 700, 800 shown in FIGS. 6A through 8B, which include the fluid flow pathways 610, 710, 810 partially defining the cutting surfaces 614, 714, 814), the fluid flow pathway(s) may also reduce (e.g., relieve) stresses in the cutting table(s) as the one or more cutting elements 900 are secured within the pockets 909 in the blades 911 of the bit body 913 of the rotary drill bit 907. Each of the cutting elements 900 may be substantially the same as each other of the cutting elements 900, or at least one of the cutting elements 900 may be different than at least one other of the cutting elements 900.

During use and operation, the rotary drill bit 907 may be rotated about a longitudinal axis thereof in a borehole extending into a subterranean formation. As the rotary drill bit 907 rotates, at least some of the cutting elements 900 provided in rotationally leading positions across the blades 911 of the bit body 913 may engage surfaces of the borehole with cutting edges thereof and remove (e.g., shear, cut, gouge, etc.) portions of the subterranean formation. In addition, as the rotary drill bit 907 rotates, drilling fluid within the borehole may be received by and may flow through fluid flow pathways (e.g., the fluid flow pathways 110, 410, 510, 610, 710, 810 previously described herein) extending into the cutting elements 900 to internally cool cutting tables (e.g., the cutting tables 104, 404, 504, 604, 704, 804 previously described herein) of the cutting elements 900. The fluid flow pathways in the cutting elements 900 may also modify flow vectors of the drilling fluid to controllably influence the trajectory of the removed portions (e.g., cuttings) of the subterranean formation.

The cutting tables, cutting elements, and earth-boring tools of the disclosure may exhibit increased performance, reliability, and durability as compared to conventional cutting tables, conventional cutting elements, and conventional earth-boring tools. The configurations of the cutting tables of the disclosure (e.g., including the configurations and positions of the fluid flow pathways thereof) advantageously facilitate efficient internal cooling of the cutting tables using drilling fluid during the use and operation of the cutting tables. The cutting tables, cutting elements, earth-boring tools, and methods of the disclosure may provide enhanced drilling efficiency as compared to conventional cutting tables, conventional cutting elements, conventional earth-boring tools, and conventional methods.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. A cutting table, comprising:

a hard material attached to a supporting substrate; and a fluid flow pathway within the hard material and configured to direct fluid proximate an outermost boundary of the hard material through one or more regions of the hard material inward of the outermost boundary of the hard material, the fluid flow pathway fluidly isolated from any additional fluid flow pathways within the supporting substrate configured to permit the flow of drilling fluid therethrough.

2. The cutting table of claim 1, wherein the fluid flow pathway is longitudinally offset from an uppermost longitudinal boundary of the hard material.

3. The cutting table of claim 2, wherein the fluid flow pathway comprises:

at least one port at an outermost lateral boundary of the hard material and configured to receive the fluid into the hard material; and at least one other port in fluid communication with the at least one port and configured to direct the fluid out from the hard material.

4. The cutting table of claim 2, wherein the fluid flow pathway extends substantially continuously in a non-linear path within the hard material.

5. The cutting table of claim 4, wherein the non-linear path of the fluid flow pathway comprises:

at least one arcuate section; and at least one substantially linear section laterally extending from an outermost lateral boundary of the hard material to the at least one arcuate section.

6. The cutting table of claim 2, wherein each section of the fluid flow pathway longitudinally extends to substantially the same depth within the hard material.

7. The cutting table of claim 2, wherein the fluid flow pathway extends to different depths within the hard material.

8. The cutting table of claim 2, wherein the fluid flow pathway exhibits a substantially circular cross-sectional shape.

9. The cutting table of claim 1, wherein an uppermost longitudinal boundary of the fluid flow pathway is substantially coplanar with an uppermost longitudinal boundary of the hard material.

10. The cutting table of claim 9, wherein the fluid flow pathway comprises:

at least one arcuate section; and at least one section laterally extending from an outermost lateral boundary of the hard material to the at least one arcuate section.

11. The cutting table of claim 9, wherein each portion of the fluid flow pathway extends to substantially the same maximum depth within the hard material.

12. The cutting table of claim 9, wherein different portions of the fluid flow pathway extend to different depths within the hard material.

13. The cutting table of claim 9, wherein different portions of the fluid flow pathway exhibit different widths than one another.

14. The cutting table of claim 1, wherein the fluid flow pathway is asymmetrically distributed within the hard material.

15. A cutting element, comprising:

a supporting substrate; and a cutting table over the supporting substrate and exhibiting a side surface and a cutting surface, the cutting table comprising:

a hard material; and a fluid flow pathway within the hard material and configured to receive fluid at the side surface of the cutting table and to direct the drilling fluid through one or more regions of the hard material inward of the side surface of the hard material, the fluid flow pathway fluidly isolated from any additional fluid flow pathways within the supporting substrate configured to permit the flow of drilling fluid therethrough.

16. The cutting element of claim 15, wherein the fluid flow pathway is longitudinally offset from the cutting surface of the cutting table, and laterally extends into the hard material from the side surface of the cutting table.

17. The cutting element of claim 15, wherein the fluid flow pathway longitudinally extends into the supporting substrate.

18. An earth-boring tool comprising:

a structure having at least one pocket therein;

at least one cutting element secured within the at least one pocket in the structure, and comprising:

a supporting substrate; and a cutting table over the supporting substrate and exhibiting a side surface and a cutting surface, the cutting table comprising:

a hard material; and a fluid flow pathway within the hard material and configured to receive fluid from an inlet port at the side surface of the hard material, through one or more regions of the hard material inward of the side surface of the hard material, and to an outlet port in the side surface of the hard material, the fluid flow pathway fluidly isolated from any additional fluid flow pathways within the supporting substrate configured to permit the flow of drilling fluid therethrough.

* * * * *